United States Patent [19]

Autio

[11] Patent Number: 4,699,692

[45] Date of Patent: Oct. 13, 1987

[54] METHOD IN A PAPER MACHINE PRESS SECTION FOR FACILITATING REPLACEMENT OF PRESS ROLLS AND FABRICS

[75] Inventor: Markku Autio, Jyväskylä , Finland

[73] Assignee: Valmet Oy, Finland

[21] Appl. No.: 841,437

[22] Filed: Mar. 19, 1986

Related U.S. Application Data

[62] Division of Ser. No. 727,104, Apr. 25, 1985, Pat. No. 4,608,125.

[30] Foreign Application Priority Data

Nov. 29, 1984 [FI] Finland ..... 844,693

[51] Int. Cl.[4] ..... D21F 1/26; D21F 3/04

[52] U.S. Cl. ..... 162/199; 162/200

[58] Field of Search ..... 162/199, 200, 272, 273, 162/274, 358, 360.1

[56] References Cited

U.S. PATENT DOCUMENTS

| | | | |
|---|---|---|---|
| 3,080,913 | 3/1963 | Hornbostel | 162/300.1 |
| 4,192,711 | 3/1980 | Tapio et al. | 162/272 |
| 4,211,165 | 7/1980 | Schill | 162/272 |
| 4,267,018 | 5/1981 | Haltsonen et al. | 162/273 |
| 4,440,593 | 3/1984 | Koski et al. | 162/360.1 |
| 4,452,668 | 6/1984 | Vallius et al. | 162/274 |
| 4,481,078 | 11/1984 | Niemi | 162/274 |
| 4,560,441 | 12/1985 | Kraft et al. | 162/273 |

*Primary Examiner*—S. Leon Bashore
*Assistant Examiner*—K. M. Hastings
*Attorney, Agent, or Firm*—Steinberg & Raskin

[57] ABSTRACT

A frame construction and method in a paper machine press section having a compact press roll combination forming at least two press nips through which a paper web runs, the frame consturction and method facilitating the removal and replacement of the fabrics and/or press rolls. The frame consturction of the press section includes, in the direction of web run through the press section, a front frame situated before the press roll combination and a rear frame separate from the front frame situated after the roll combination. The space above the roll combination and between the front and rear frames is open or openable through the provision of an intermediate frame situated above the roll combination. The intermediate frame is pivotally mounted on the rear frame about a transverse axis located at a longitudinal side of the roll combination. The pick-up fabric and the upper fabric, if any, of the press and/or one or more of the press rolls of the press roll combination can be easily replaced utilizing the open space provided by pivoting the intermediate frame to its open position.

3 Claims, 6 Drawing Figures

METHOD IN A PAPER MACHINE PRESS SECTION FOR FACILITATING REPLACEMENT OF PRESS ROLLS AND FABRICS

This is a division of application Ser. No. 727,104, filed 4/25/85 now U.S. Pat. No. 4,608,125.

BACKGROUND OF THE INVENTION

The present invention relates to a method in a compact press section of a paper machine which includes a compact press roll combination, the rolls of which form at least two press nips with each other through which a paper web runs, by which method the fabrics in the press section and/or the press rolls of the compact press roll combination can be easily replaced. The method is applied in a frame construction for the press section which includes, in the direction of the run of the paper web, a front frame situated before the roll combination and a rear frame situated after the roll combination.

The invention also relates to a frame construction in a compact paper machine press section suitable for use in the practice of the method. The frame construction is for a press section which includes a compact press roll combination whose press rolls form at least two and preferably three or more press nips with each other, the paper web running between the press nips, preferably as a closed draw.

In the frame construction of conventional compact press sections of paper machines, such as in the Sym-Press paper machine press section available from Valmet Oy of Finland, front and rear frames are provided before and after the compact press roll combination which are permanently connected to each other by horizontal beams located at both the operating and service sides of the paper machine. As used herein, "front frame" means the frame part that is situated before the compact press roll combination in the direction of web run through the press section and on which the upper press roll, conventionally a suction roll, of the first press nip is usually mounted. Correspondingly, "rear frame" means the frame part which is situated after the press roll combination.

Conventional frame constructions for compact paper machine press sections present difficulties in connection with the replacement of the press fabrics and press rolls. These problems have become more serious as the widths of the paper machines have increased since the press rolls are longer and heavier. Moreover, additional problems have been created by the increasing use of press fabrics formed of plastic materials. When formed of plastic, the press fabrics tend to be substantially rigid in the transverse direction which prevents the press fabrics from being compressed into a small volume, since this would cause the fabrics to become wrinkled and therefore not usable.

In an attempt to overcome the problems described above, Beloit Corporation of Beloit, Wis. has suggested a frame construction, designated as its "flip-top" construction, wherein either the top part of the front frame or the top part of the rear frame can be opened by rotating it about a pivot shaft whose axis is parallel to the transverse direction of the paper machine and which is situated above the press rolls. As a consequence of this construction, the two top parts of the frames cannot be opened at the same time.

In order to replace the pick-up fabric of a press section incorporating a "flip-top" frame construction , which fabric usually functions as the press fabric in the first and second press nips, the top part of the front frame is opened. During this procedure, however, the top part of the rear frame must be locked since the top part of the front frame, when opened, is supported on the top part of the rear frame. In a corresponding manner, the top part of the rear frame can be opened, such as in connection with the replacement of the press fabric in the third press nip, only when the top part of the front frame is closed and locked in position. The lower fabric of the first nip, which runs mainly in the basement space, is replaced by means of conventional arrangements.

The "flip-top" frame construction described above can be characterized as a type of "drawbridge" which is openable at an articulated joint which is situated in the middle of the drawbrige directly above the compact roll combination and wherein only one-half of the bridge can be opened at any one time.

The fact that the articulated joint of the "flip-top" frame construction is situated immediately above the compact press roll combination has been found to be a drawback in that this construction does not greatly facilitate the replacement of the press rolls. Rather, the press rolls must be replaced in the conventional manner by shifting them in their axial directions to the side of the paper machine. Such axial shifting requires that the grasping point at which the roll is supported on the hooks of a traverse crane must change from time to time. The press rolls must be shifted a distance equal to their entire length to the service side of the paper machine thereby requiring that the width of the aisle at the service side of the machine must be at least equal to the length of the rolls, e.g., about 8 to 10 meters. Absent this requirment, the aisle at the service side of the paper machine would not have to be so wide. It would be highly advantageous from the viewpoint of reducing the cost of construction of the paper machine hall to be able to reduce the width dimension of the aisle at the service side of the paper machine.

Another drawback of the "flip-top" frame construction described above is that when one of the top parts of the frame is opened, only a single felt can be replaced. If, after replacement of one felt, it is desired to replace another felt, it is necessary to close and lock the initially opened top frame part and then unlock and open the other top frame part. Consequently, the replacement of felts as well as press rolls in a press section provided in a frame construction of the type described above is a relatively lengthy procedure thereby increasing the downtime of the paper machine.

The downtime of the press section is also increased during replacement of felt and rolls due to the fact that the grasping point of the crane must be changed several times during the fabric or roll replacement operation.

Conventional methods used in the replacement of felts and rolls in press sections mounted in prior art frame constructions are difficult and slow for the additional reason that a sufficiently large open space has not been available for the replacement operations, particularly in the region above the rolls in the press section. It has therefore been necessary to perform the work in a very limited space thereby increasing both the time required to effect the roll and/or felt replacement as well as the hazards inherent in the operation.

SUMMARY OF THE INVENTION

It is an object of the present invention to provide new and improved frame constructions of press sections and methods for replacing fabrics and press rolls in a press section so that such replacement can be effected more rapidly and in a simpler manner than has been possible heretofore.

Another object of the present invention is to provide new and improved frame constructions and methods for replacing press fabrics and/or press rolls which avoid the drawnbacks of conventional arrangements as described above.

Still another object of the present invention is to provide new and improved frame constructions and methods for replacing press fabrics and/or press rolls wherein the width of the aisle at the service side of the paper machine can be reduced thereby providing significant savings in the construction costs of the paper machine hall.

Briefly, in accordance with the invention, these and other objects are attained by a method for replacing the fabrics and/or the rolls in a compact press section wherein the space above the press roll combination of the compact press section and between the front and rear frames is arranged to be open or, alternatively, openable by pivoting an intermediate frame into an open position, such pivoting being performed with respect to an articulated joint having a pivot axis which extends transversely to the longitudinal direction of the paper machine and which is situated at the rear frame to the longitudinal side of the roll combination. The open space above the roll combination is used, either directly or indirectly, for replacing at least the pick-up fabric or a corresponding fabric and the upper fabric, if any, of the press section and/or the replacement of one or more press rolls of the compact press roll combination.

A frame construction in accordance with the invention includes, in the direction of web run through the press section, a front frame situated before the press roll combination and a rear frame separate from the front frame situated after the roll combination, and an intermediate frame situated above the press roll combination. The intermediate frame is pivotally mounted on the rear frame at a longitudinal side of the press roll combination by means of a pivot shaft whose axis extends transversely to the longitudinal direction of the paper machine. The intermediate frame is releasably attached to the front frame by an openable joint between. Actuating means are provided for pivoting the intermediate frame about the pivot shaft into an open position so that a space is thereby opened above the press roll combination which can be utilized in connection with the replacement of the press rolls and/or the fabrics of the press section.

Like the prior art "flip-top" frame construction described above, the arrangement of the invention can be characterized as a type of "drawbridge." However, unlike the prior art arrangment, the "drawbridge" is formed by an intermediate frame which is situated between the front and rear frames of the press section. Unlike the prior art construction wherein the top parts of the front and rear frames are articulated immediately above the compact press roll combination, the intermediate frame of the frame construction of the invention is articulated at a sufficient distance to the side of the press roll combination so that the intermediate frame is located above the first, second and third, if applicable, press nip. When the intermediate frame is opened, an open space is created which is situated immediately above the press rolls so that at least the center roll of the press combination, which is usually a rock roll, is completely exposed when viewed from above.

In one embodiment of a frame construction in accordance with the invention, an auxiliary frame is mounted at the top portion of the front frame by means of a pivot shaft whose axis extends transversely to the direction of the paper machine so that the auxiliary frame can be pivoted to an open position in a direction opposite to the pivoting direction of the intermediate frame in order to facilitate the replacement of the pick-up felt. In this embodiment of the invention, the top of the frame construction resembles a "drawbridge" consisting of a pair of bridge flap members which are pivotally mounted at mutually opposite sides relative to each other so that a larger free space is created above the frame construction of the press section when the flap members are pivoted to their open positions in connection with the replacement of the press rolls, possibly the pick-up roll, and the fabrics of the press section.

DETAILED DESCRIPTION OF THE DRAWINGS

A more complete appreciation of the present invention and many of the attendant advantages thereof will be readily understood by reference to the following detailed description when considered in connection with the accompanying drawings in which.

Figure 4:
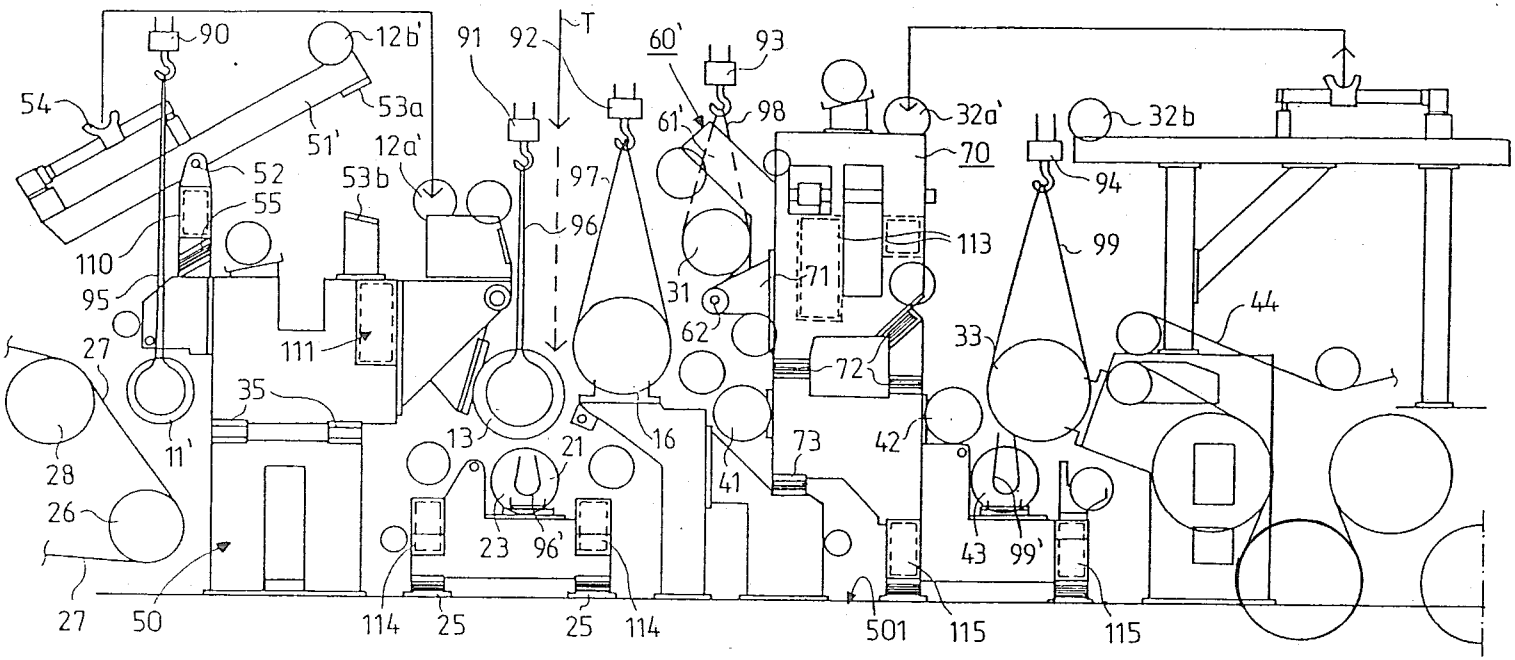
FIG. 4 is a view similar to FIG. 1 illustrating the replacement of press rolls in a press section of the type shown in FIGS. 1–3.
Figure 5:
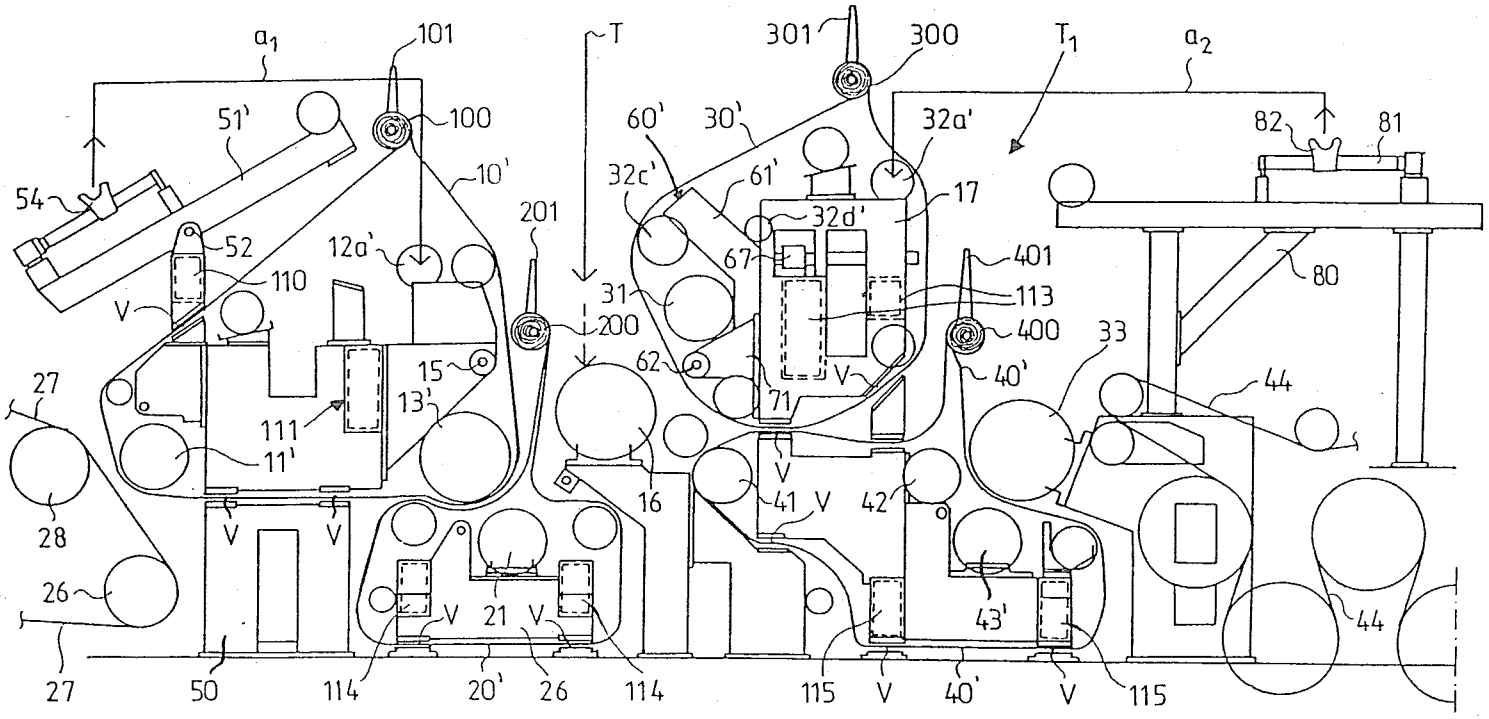
Figure 6:
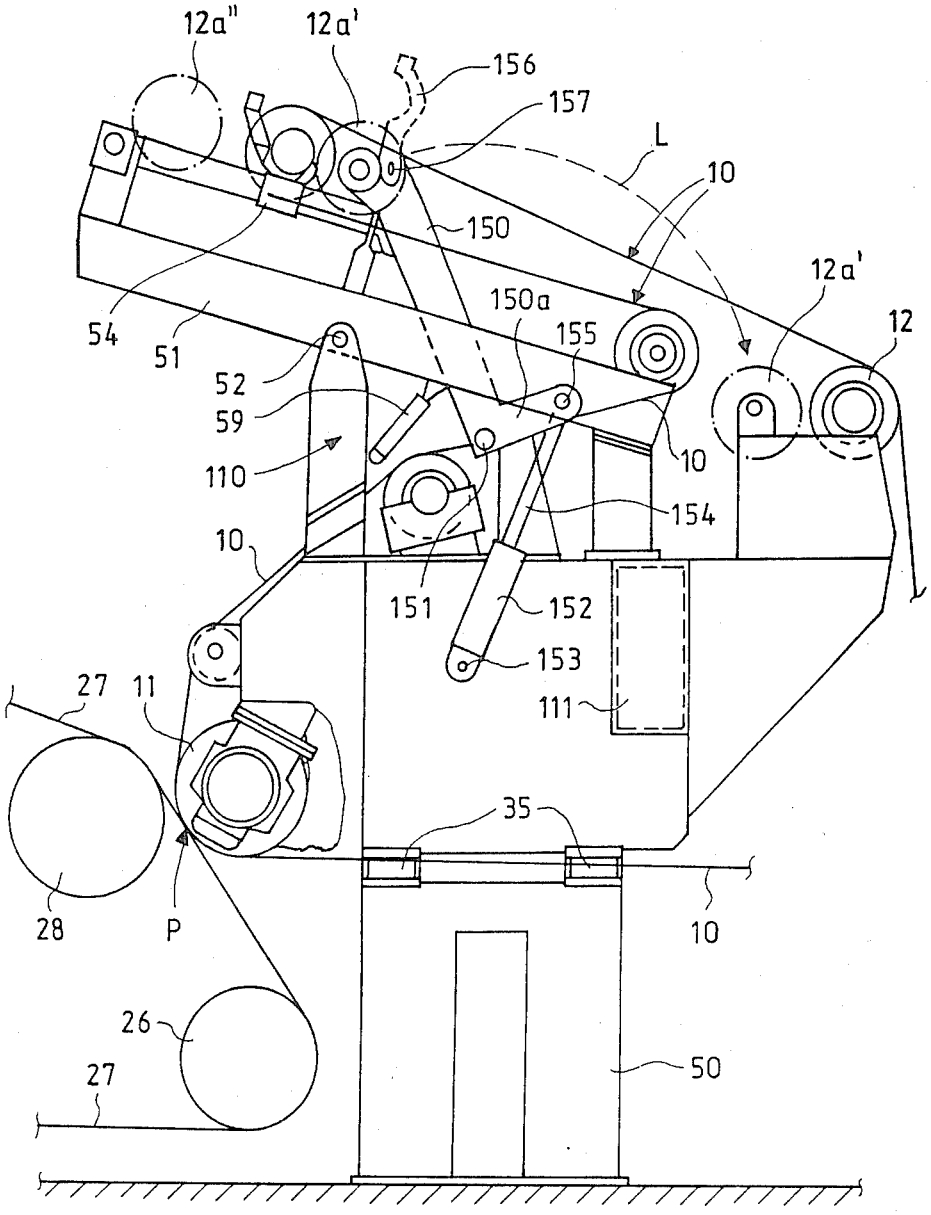

FIG. 5 illustrates the replacement of the pick-up and press felts in a press section of the type shown in FIG. 4; and FIG. 6 is a schematic side elevation view of a front frame constituting part of a frame construction in accordance with the invention, the front frame provided with pivoting levers and actuating means by which the tensioning roll for the pick-up fabric can be shifted during replacement of the fabric to a temporary holding position.

DESCRIPTION OF THE PREFERRED EMBODIMENTS

Figure 1:
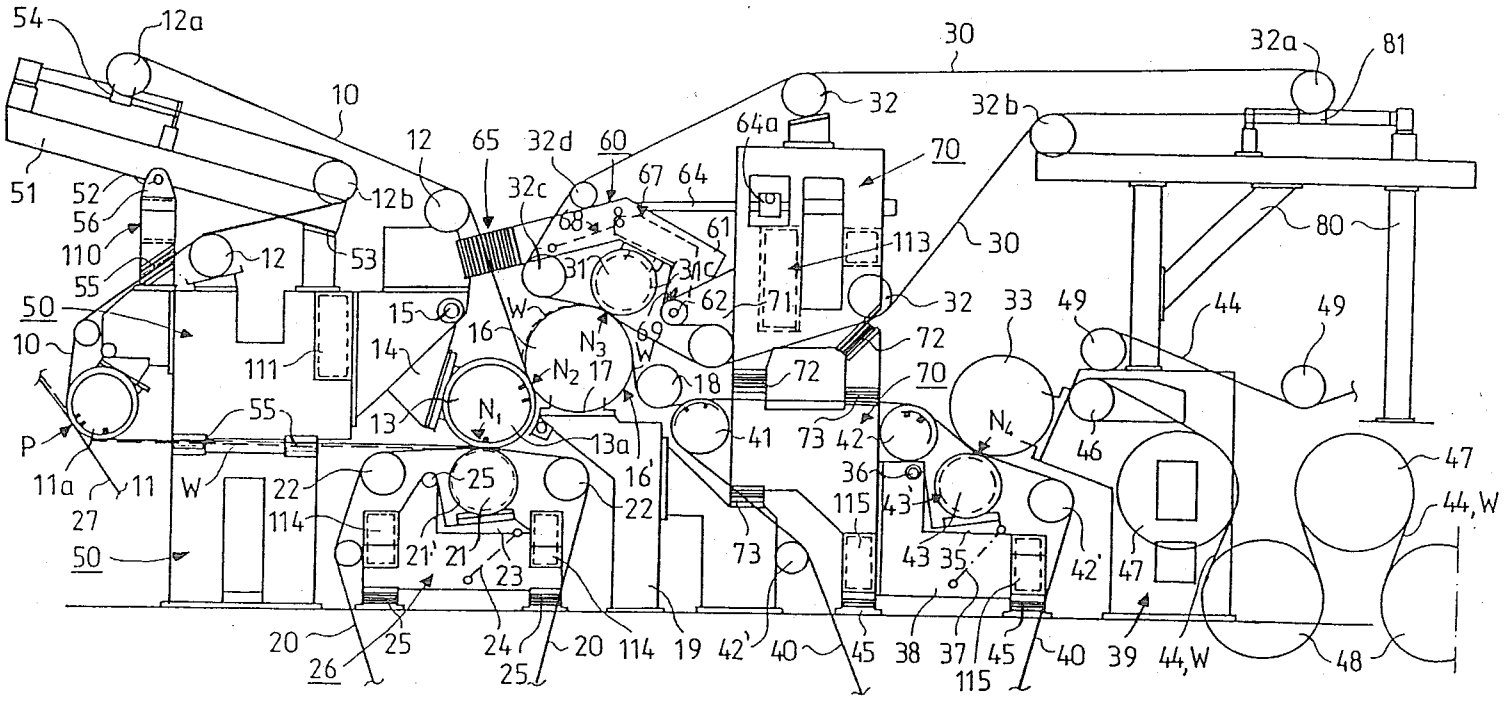
FIG. 1 is a schematic side elevation view of a press section of a paper machine illustrating a frame construction in accordance with the invention and with which the method of the invention can be carried out.

Referring now to the drawings wherein like reference characters designate identical or corresponding parts throughout the several views, and more particularly to FIG. 1, the press section comprises a compact or closed press roll combination including press rolls 13, 16, 21 and 31 which form three successive press nips $N_1$, $N_2$ and $N_3$ between them. The press section also includes a fourth, separate press nip $N_4$ formed between press rolls 33 and 43. A first fabric 10 passes through the first and second press nips $N_1$ and $N_2$ and acts as a pick-up fabric. A second fabric 20 passes through the first press nip $N_1$. A third press fabric 30 runs through the third press nip $N_3$ and a fourth press fabric 40, which is a lower press fabric, passes through the fourth press nip $N_4$.

A pick-up roll 11 having a suction zone 11*a* is situated within the loop of the first fabric 10 and serves to transfer the web from the forming fabric 27 onto the run of fabric 10 between the rolls 11 and 13. Fabric 10 is guided by guide rolls 12 including a tensioning guide roll 12*a*. Second fabric 20 is guided by guide rolls 22 and fabric 30 is guided by guide rolls 32 including tensioning guide roll 32*a*. Guide roll 32*b* is mounted on a frame portion 80 and guide rolls 32*c* and 32*d* are mounted on a pivotally mounted intermediate frame 60, described in greater detail below. The fourth fabric 40 on which the web W is transferred from the region of transfer roll 18 into the last press nip $N_4$ is guided by suction transfer rolls 41 and 42 as well as by guide rolls 42'.

The passage of the web W from the pick-up point P through the press section will now be described. The web W is picked up from the wire 27 by the suction sector 11*a* of pick-up roll 11 and is attached onto the bottom face of the fabric 10 on which the web W is carried into the first two-fabric press nip $N_1$. The lower roll 21 of press nip $N_1$ is provided with a hollow face 21'. The web W follows the first fabric 10 after the first press nip $N_1$ under the effect of the suction sector 13*a* of suction roll 13. As the web W passes through the second press nip $N_2$, it is transferred onto the smooth face 16' of the central roll 16 on which it is carried into the third press nip $N_3$. After passing through nip $N_3$, the web remains on the central roll 16 whereupon it is guided by the transfer roll 18 onto the fabric 40 within the suction sector of suction roll 41. The web carrying fabric 40 passes over suction roll 42 and passes into the last press nip $N_4$. After passing through nip $N_4$, the web W follows the smooth-faced press roll 33 from which it is transferred onto the guide roll 46 and onto a single-draw fabric 44 of the drying section, guided by guide rolls 49. The web carrying drying fabric carries the web between the drying cylinders, of which two upper cylinders 47 and two lower cylinders 48 are seen in FIG. 1.

The construction and operation of the press section described above are conventional and are described solely in order to facilitate a better understanding of the embodiments of the invention described below.

The method and frame construction in accordance with the invention can also be used in a press section including a compact press roll combination, but wherein the web also has open draws. The various press rolls may also be mounted in a manner which differs from that shown herein.

The frame construction of a press section in accordance with the invention includes a front frame 50 onto the top of which an auxiliary frame 51 is pivotally mounted by means of articulated joints 52 having transversely extending horizontal axes of rotation. Tensioning guide roll 12*a* and guide roll 12*b* of the first fabric 10 are mounted on the auxiliary frame 51, the tensioning roll 12*a* being mounted through the intermediary of a tensioning device 54 for the purpose of tensioning the fabric 10. Thus, the tension of fabric 10 can be increased by moving the tensioning guide roll 12*a* on the tensioning device 54 in the direction of the forming section of the paper machine, i.e., to the left as seen in FIG. 1. The front frame 50 is provided with openable intermediate members 55 which, when opened, provide a space through the front frame 50 through which the first fabric 10 can be passed in connection with its replacement. The pivotable auxiliary frame is shown in its normal operating position in FIG. 1. In this normal operating position, the auxiliary frame 51 slants downwardly in the direction of web run through the press section. The end of the frame part 51 proximate to the press section is releasably attached to the front frame 50 by means of a joint 53 which, as best seen in FIG. 4, comprises a pair of flanges 53*a* and 53*b* which are situated flush with each other when the auxiliary frame is its normal operating position and which are attached to each other such, for example, as by bolts or the like.

The suction roll 13 of the press section is mounted to a second intermediate frame 14 which is itself pivotally mounted to the front frame 50 by transverse pivot shafts 15. The lower press roll 21 of the first nip $N_1$ is mounted on a sub-frame 23 which is pivotally mounted to a lower frame 26 by means of transverse pivot shafts 25. The first press nip $N_1$ can be loaded by means of power units 24 fitted between the sub-frame 23 and the lower frame 26. The second press nip $N_1$ is loaded by means of power units fitted between the second intermediate frame 14 and the front frame 50.

The frame construction in accordance with the invention also includes a rear frame 70 which is separate from the front frame 50 and which is situated after the press roll combination 21, 13, 16, 31 in the direction of web run through the press section. Flanges 71 project from the forward side of the rear frame 70 and a first intermediate frame 60 is mounted to the flanges 71 by means of transverse horizontal pivot shafts 62.

The intermediate frame 60 is situated vertically above the compact press roll combination and the pivot axis 62 about which the intermediate frame 60 rotates is located at a longitudinal side of the roll combination. The other end of the intermediate frame 60 is releasably attached to the front frame 50 so that the front frame 50 and rear frame 70 are connected to each other by the intermediate frame 60 to provide a sufficiently rigid unit capable of withstanding normal vibrations and the like. The forward end of the intermediate frame 60 may be connected to the front frame 50 by an intermediate member 65 having ends which are releasably connected to the front and intermediate frames 50 and 60 by means of bolts or the like which can be opened relatively rapidly.

The central press roll 16 of the press is mounted on its own stationary frame component 19 located between the frame part 26 from which the sub-frame 23 is mounted and the rear frame 70. The press roll 31 of the third press nip $N_3$ is journaled on a third intermediate frame 67, shown in phantom in FIG. 1. The third intermediate frame 67 is pivotally mounted on the intermediate frame 60 by means of pivot shafts 69 whose axes are substantially coincident with the axes of the pivot shafts 62 of the first intermediate frame 60. The third intermediate frame 67 on which the press roll 31 is mounted can be pivoted with respect to the first intermediate frame 60 by means of power units 68 which also function to load the third press nip $N_3$ formed between press rolls 31 and 16.

In order to pivot the first intermediate frame 60 to its open position as described below, actuating means 64, 64*a* are mounted on the rear frame 70 for pivoting the first intermediate frame 60 about pivot shafts 62 from the operating position shown in FIG. 1 to the open position shown in FIGS. 4 and 5. The actuating means may take the form of a screw motor 64*a* and arms 64 having ends connected to the first intermediate frame 60.

A frame part 38 is provided in back of the rear side of the rear frame 70. The transfer suction roll 42 as well as the lower roll 43 of the fourth press nip $N_4$ are mounted on the frame part 38. The press roll 43 is mounted on a sub-frame 35 which is pivotally mounted on the frame part 38 by a pivot shaft 36. A power unit 37 is connected to the sub-frame 35 to load or open the fourth press nip $N_4$. The upper press roll 33 of the fourth press nip $N_4$ is journaled on a stationary frame part 39. Guide rolls 46 and 49 as well as the first drying cylinder 47 or a corresponding lead-in cylinder are also mounted on the frame part 39. An upper frame 80 is provided above the frame part 39 on which guide and tensioning roll **32*a* and guide roll 32*b* of fabric 30 are mounted. The guide and tensioning roll 32*a* is supported on a tensioning device 81 that can be displaced rearwardly to tension the fabric 30. Fabric reconditioning devices (not shown) are preferably provided at the top ide of the frame part 80**.

Figure 2:
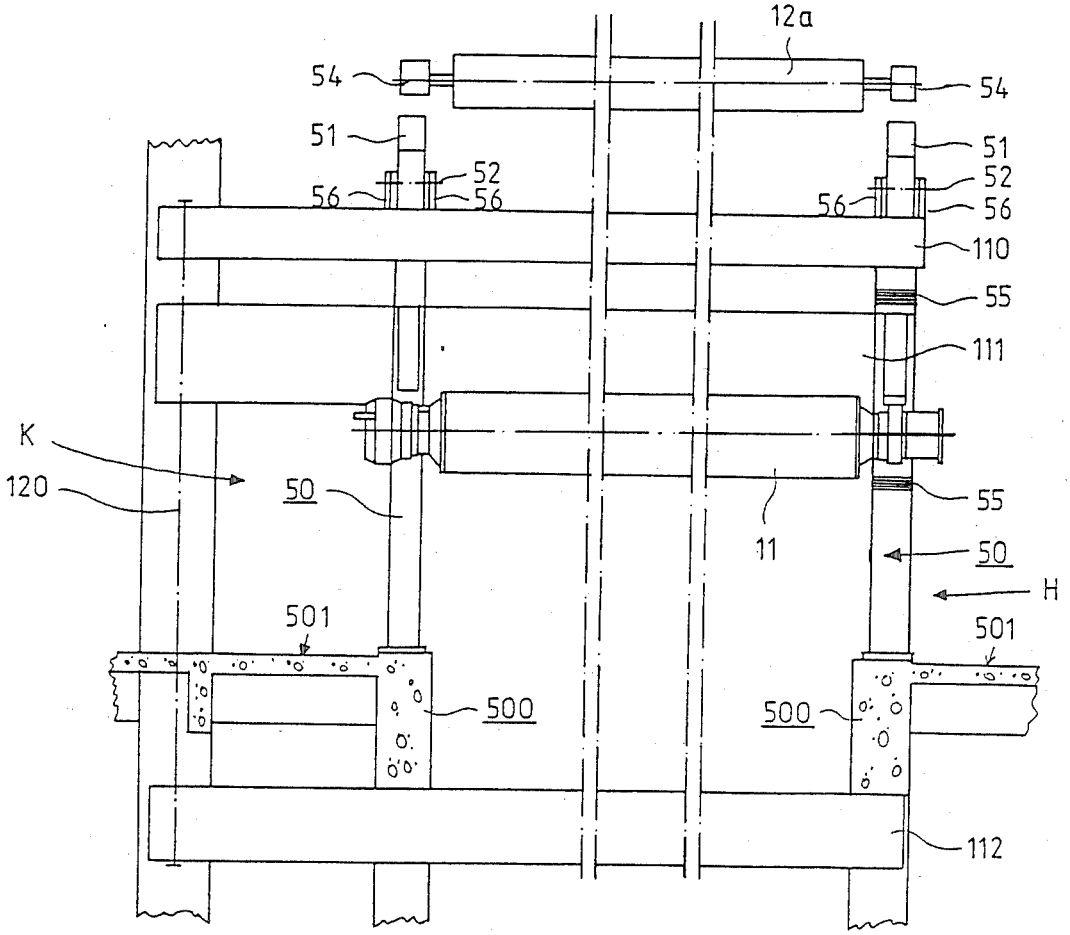
FIG. 2 is a front elevation view of the press section of FIG. 1 in the direction of arrow A.
Figure 3:
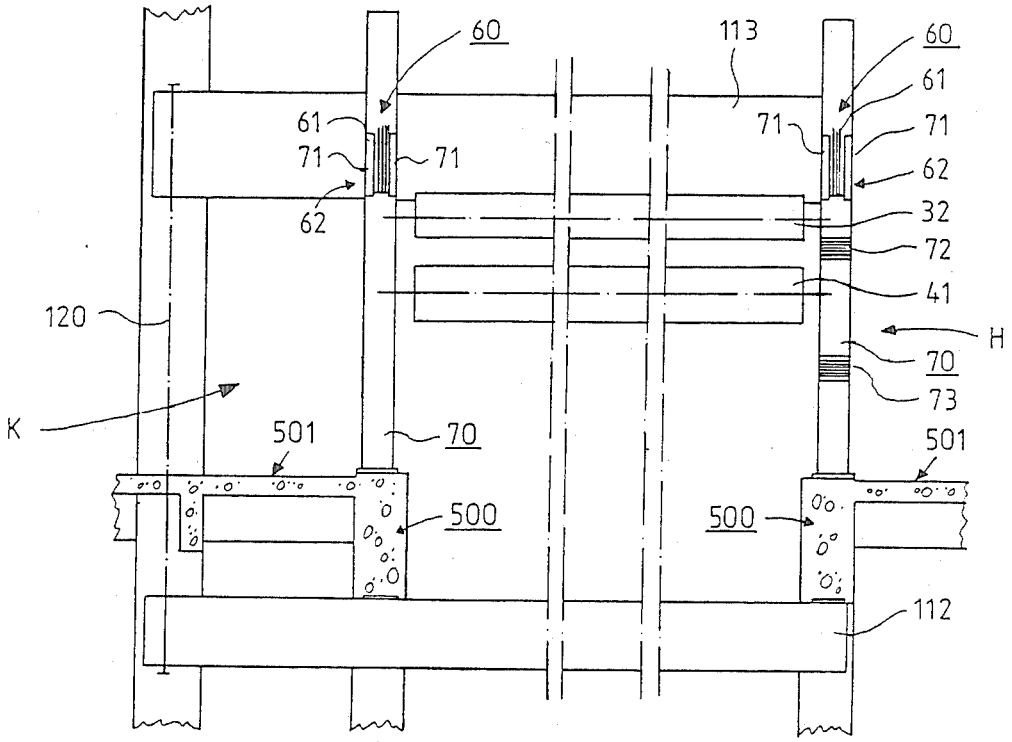
FIG. 3 is a section view of the press section of FIG. 1 with certain elements being omitted for the sake of clarity.

Referring to FIGS. 2 and 3 in conjunction with FIG. 1, the operating side of the paper machine is designated K and the service side of the machine is designated H. The operating and service sides of the front frame 50 (FIG. 1) of the auxiliary frame 51 and of the lower frame are connected together by cantilever beams 110, 111 and 114 which are supported on a lower beam 112 by means of traction members 120. The horizontal pivot shafts 52 of auxiliary frame 51 and the flanges 56 for the pivot shafts 52 are shown in FIG. 2. The foundation of the paper machine building is designated 500 and the plane of the floor is designated 501.

Replacement of the press rolls in accordance with the method of the invention is illustrated in FIG. 4. As seen in FIG. 4, the auxiliary frame 51 is pivoted about the pivot shafts 52 into its open position 51'. The joint 53 is opened prior to pivoting the auxiliary frame as described above. It is of course necessary to remove a fabric surrounding a roll prior to removal of that roll. As seen in FIG. 4, lifting ropes 95 suspended from lifting hooks 90 of a traverse crane are attached to the axle journals of the suction roll 11'. The pick-up roll is thus replaced in a conventional manner.

Prior to replacing the press rolls 13, 16 and 21, intermediate frame members 65 of the first intermediate frame 60 are opened as described above and the first intermediate frame 60 pivoted to its open position 60' in which the side beams 61 of the intermediate frame are in the position designated 61' in FIG. 4. In this manner, an open space T is created above the press roll combination through which space the lifting of the press rolls 13, 21 and 16 can be carried out.

The suction press roll 13 of the compact press combination is suspended on lifting lines 96 attached to a lifting hook 91. Suction roll 13 is lifted upwardly using a so-called center lifting technique whereupon the roll is simultaneously shifted to the side of the press section and turned within the open space T about a vertical axis. Subsequently, the lower roll 21 of the first press nip $N_1$ is lifted in the same manner by means of lifting lines 96'. The suction roll 13 may be lifted either by its axle journals using a pair of lifting ropes or by the so-called center lifting technique described above by means of lifting lines.

When the first intermediate frame 60 is in its open position 60', the press roll 31 of the third press nip $N_3$ can also be replaced by a center lifting technique using lifting ropes or lines 98 suspended from a lifting hook or hooks 93. Prior to such replacement, it may be necessary to shift the guide and tensioning roll **32*a* of fabric 30 to a temporary holding location, designated 32*a*'**.

After the roll **32*a* has been shifted to position 32*a*' and the third fabric 30 removed from the press section, a free space $T_1$ (FIG. 4) is opened above the fourth nip $N_4$ so that the press rolls 33 and 43 can also be removed from the press section by a center lifting technique. As seen in FIG. 4, press roll 33 is lifted by means of lifting lines 99 attached to lifting hooks 94 while press roll 43 is lifted by lifting lines 99'**.

The center lifting technique by which the press rolls 13, 21, 16, 31, 33 and 43 are removed from the press section involves suspending each roll from a single crane hook by lifting lines which support the roll in a downwardly opening V-form symmetrically at both sides of its vertical central plane. The center lifting technique is advantageous in that each roll can be rotated in a horizontal plane around its vertical central axis which facilitates the shifting of the rolls in the crowded space of the press section. On the other hand, when a roll is lifted by its axle journals, it can usually be shifted only in its longitudinal direction, i.e., the roll usually cannot be rotated about its vertical central axis, since the cooperative operation of two cranes is difficult and dangerous.

Although the replacement or servicing of press rolls 11, 13, 21, 31, 33 and 43 has been described above as taking place at the same time, it is understood that in practice only a single roll will generally require replacement or servicing at any one time. Accordingly, it will be necessary to only remove the necessary number of fabrics and open the necessary frame parts at any one time.

Referring to FIG. 5, replacement of all of the press fabrics in the press section is illustrated, it being understood that in practice all of the fabrics are not generally replaced at one time. In the replacement of the first fabric 10, the auxiliary frame 51 mounted on the front frame 50 is pivoted around the pivot shaft 52 to its open position 51' and the tensioning guide roll **12*a* which is normally mounted on the tensioning device 54 is relocated to the temporary holding location 12*a*' along the path designated by arrow $a_1$ in FIG. 5. In order to replace fabric 30, the first intermediate frame 60 is pivoted to its open position 60'** to form the open space T above the compact press roll combination to thereby facilitate the replacement of this fabric.

In connection with the replacement of the first fabric 10, the intermediate frame components 55 at the service side of the front frame 50 are opened so that open gaps V are provided in the frame through which the felt loop 10' can be passed. Suction roll 13 is shifted to the position designated 13' by pivoting the second intermediate frame 14 (FIG. 1) and the press roll 21 is shifted to its lower position 21' by pivoting the sub-frame 23 (FIG. 1). The intermediate frame components 25' of frame 26 are opened in connection with the replacement of the second fabric 20.

In the replacement of the third fabric 30, the intermediate frame components 72 and 73 are opened and the tensioning guide roll **32*a* is removed from the tensioning device 82 and shifted along the path $a_2$ (FIG. 5) to the temporary holding location 32*a*' located over the rear frame 70. The first intermediate frame 60 has already been pivoted into its open or inner position 60' so that the press roll 31 and guide rolls 32*c* and 32*d* are also pivoted to their respective inner positions 31, 32*c*' and 32*d*' (FIG. 5**).

In connection with the replacement of the lower fabric 40 of the fourth press nip $N_4$, the intermediate frame components 72, 73 and 45 are removed to create the open spaces V and the press nip $N_4$ is opened by pivoting sub-frame 35 whereupon the fourth press fabric 40 can be removed from the press section through the open space $T_1$.

As described below, a new fabric 40 is unwound from a felt roll 400 which is pushed along a rail (not shown) situated in the space between the intermediate frame components 72 and 73 of the press section.

Referring to FIG. 5, a new first fabric 10 is unwound from a roll 100. The fabric roll 100 is supported on a pole which is carried by lifting wires 101 which is brought to the service side of the press section. A loop 10' is unwound from the fabric roll 100 and passed through the spaces V, the open press nips $N_1$ and $N_2$ and around a cantilever beam 111 to its operating position. The tensioning guide roll 12a' is then shifted to its operating position on the tensioning device 54 and the auxiliary frame 51' is pivoted back to its closed position 51 (FIG. 1) whereupon the joint 53 is fastened.

In the replacement of the second fabric 20, a fabric roll 200 is carried to the service side of the paper machine by means of a pole carried by wires 201 whereupon a loop 20' of second fabric is unwound from the roll 200 and passed through the open spaces V and through the opened first press nip $N_1$ to its operating position around the cantilever beams. Prior to unwinding the new second fabric from the roll 200, the tensioning and guide rolls of the fabric 20 that are located in the basement space below the floor level 501 are shifted to the upper position below the roll 21 to the level of the cantilever beams 114, such as by the arrangement disclosed in Finnish patent application Ser. No. 803020 (U.S. Pat. No. 4,481,078). At this time, the pole supporting the roll 200 is shifted on the carry wires 201 towards the space T in the position shown in FIG. 5 whereby the second fabric 20 becomes positioned in its operating position around the cantilever beams 114, the nip $N_2$ being opened to a sufficient extent.

The replacement of the third press fabric 30 is carried out by unwinding a loop 30' from a fabric roll 300 supported on a pole carried by wires 301 and by passing the fabric loop through the spaces V around the cantilever beams 113 and rolls 31, 32c', 32d' and 32a'.

The fourth fabric 40 is replaced in a manner similar to the replacement of the fabric 20. The fourth press nip $N_4$ is opened and a loop 40' of fabric is passed from the fabric roll 400 carried by wires 401 around the cantilever beams 115 in the manner shown in FIG. 5.

Referring now to FIG. 6, another embodiment of the auxiliary frame 51 mounted to the front frame 50 by pivot shafts 52 is illustrated. According to the embodiment of FIG. 6, the apparatus for replacing the pick-up felt 10 differs from that described above in a manner such that in order to replace the tensioning guide roll 12 of the felt 10, it is not necessary to use the cranes in the paper machine hall. Rather, the front frame 50 is provided with means for shifting the tensioning guide roll including a pair of pivot levers 150 situated at respective sides of the front frame 50. The pivot levers 150 are mounted to the front frame 50 by means of horizontal shafts 151.

The pivot levers 150 comprise L-shaped levers, each having an arm portion 150a coupled to actuating means in the form of hydraulic cylinders 152 which are connected at their lower ends to the front frame 50 by means of pivot shafts 153. The piston rods 154 of the actuating means are connected to the arm portions 150a of the pivot levers 150 by means of articulated joints. Means for connecting the tensioning guide roll 12a to the pivot levers 150 are provided at the top ends of the pivot levers. The attachment devices include locking jaws 156 which are attached to the top ends of the pivot levers 150 by means of articulated joints 157.

When the pick-up felt 10 is to be replaced, the tensioning guide roll 12a is detached from the bearing blocks of tensioning device 54 and is attached by means of the locking jaws 157 to the top ends of the pivot levers 150. The hydraulic cylinders 152 are actuated whereupon the levers 150 are pivoted to their lower positions whereupon the tensioning guide roll 12a is shifted along the path designated L in FIG. 6 to the temporary holding location 12a' provided on the top side of the front frame 50.

After the pick-up felt 10 has been replaced, the tensioning guide roll 12a is shifted from its temporary holding location back onto the tensioning device 54 on auxiliary frame 51 by operating the pivot levers 150 in reverse with respect to the sequence described above. During normal operation of the press section, the pivot levers 150 are pivoted into an inner position in which they do not obstruct the normal operation of the machine.

Power means for pivoting the auxiliary frame 51 are designated 59 in FIG. 6. The extreme upper position of the tensioning roll 12a at which the felt 10 is under greatest tension is designated 12a''.

The steps for replacing the various felts and press rolls in accordance with the invention will now be described in detail.

Pick-Up Felt 10

(1) The press section and forming section are stopped and the rolls 11, 13 and 21 are locked in their open positions.

(2) The old felt 10 is removed by means of a pin roll and a hydraulic motor.

(3) The tensioning guide roll 12a is shifted to the temporary holding location 12a'.

(4) The bolts closing joints 53 are opened.

(5) The auxiliary frame 51 is pivoted to its upper or open position 51' by means of actuating means, such as actuating means 59 (FIG. 6).

(6) The intermediate frame members 55, 65 are opened at the service side of the press section so that the remaining frame components are cantilevered by means of hydraulic cylinders to thereby open space V for the insertion of the felt 10.

(7) The bolts of the second press and of the pick-up frame are opened and the frame is cantilevered by means of hydraulic cylinders at the service side of the press section.

(8) The new fabric roll 100 is suspended from the crane 101 and the new fabric loop 10 is unwound for insertion.

(9) The new fabric loop 10 is fed into position without changing the points at which the fabric is grasped.

(10) The intermediate frame components 55 are returned to their normal positions.

(11) The auxiliary frame 51 is pivoted back to its closed or lower position.

(12) The tensioning guide roll 12a' is returned to its normal position within the tensioning device 54.

Felt 30 Of The Third Press (1) The press section in the first group of drying cylinders are stopped.

(2) The press roll 31 is raised to its upper position by pivoting the first intermediate frame 60 to its open upper position 60'.

(3) The old fabric 30 is removed.

(4) The tensioning guide roll 32a is shifted to the temporary holding location 32a'.

(5) The bolts of the intermediate frame components are opened from the service and operating sides of the press section.

(6) The frame is cantilevered by means of hydraulic cylinders and the intermediate frame components 72 and 73 are removed.

(7) Passages for the fabric through the service bridges are opened.

(8) The roll 300 of new fabric is suspended on the crane 301 and a new fabric loop 301 is unwound for insertion.

(9) The fabric loop 301 is fed into the press section without changing the grasping point of the crane.

(10) The intermediate frame components 72 and 73 are replaced.

(11) The first intermediate frame 60 is pivoted to its closed position.

(12) The tensioning guide roll 32a' is returned to its normal position on the tensioning device 81.

Press Roll Replacement (1) The press section is stopped and the roll and/or rolls 11, 13, 21, 31 and 33 are locked in the open position.

(2) The intermediate frame 60 is pivoted to its open position 60' for replacement of the press roll 31.

(3) The central rock roll 16 can be replaced by the center lifting technique through the top space T.

(4) The suction roll 13 of the second press is replaced after opening the intermediate frame 60 by lifting and at the same time rotating it to the service side of the press section without changing the grasping point of the lifting wires.

(5) The press roll 21 of the first press nip and the pick-up roll 11 are replaced in a conventional manner. If the suction roll 13 can be pivoted to a sufficient extent, the press roll 21 can be lifted directly upwardly.

In the manner described above, the fabrics 10, 20, 30 and 40 can be replaced in a simpler manner than has been possible heretofore. Adequate spaces are provided for the various replacement operations primarily through the ability to open the various frame parts to a position favorable for the replacement of the fabrics.

As is apparent from FIG. 5, the method and frame construction in accordance with the invention enables the rolls within the fabrics to be replaced to be accommodated in a very small area and close to each other so that the free loop unwound from the fabric roll to be fitted around the various press rolls and cantilever beams can be relatively small and preferably substantially drop-shaped to facilitate the insertion of the fabric. The method of the invention is also well suited to the replacement of fabrics made of plastic material which cannot be laterally compressed into a bundle.

The invention has been described in the illustrated preferred embodiments in connection with a press section in which serious problems are experienced in connection with the replacement of press rolls and, particularly, fabrics, i.e., wherein the press section has a maximum number of press rolls and a maximum number of fabrics. However, it is understood that the invention can also be applied to press sections of other types, such as to the press sections known as Sym-Press I and Sym-Press II of Valmet Oy of Finland, the former having only two press nips corresponding to the nips $N_1$ and $N_2$ without any separate press nip $N_4$, the latter having three press nips corresponding to nips $N_1$, $N_2$ and $N_3$ without any separate nip $N_4$. In such a case, either the third and fourth fabric or the fourth fabric, respectively, are omitted.

The present invention is also applicable to press sections wherein the suction roll 13 is arranged on stationary bearing supports and the central roll 16 is fitted on support arms for loading and/or opening the nips formed thereby.

In the case of low speed paper machines in which the requirements for rigidity of the press section frame are not particularly great, the openable intermediate frame 60 can be entirely omitted whereby the press section will at all times be open at the top of the compact press combination thereby in itself facilitating the replacement of the press rolls and press fabrics. Such a construction is, however, not possible in the case of high speed paper machines in which the problems of vibration and frame rigidity require a connection between the front and rear frames 50 and 70. Such connection has taken the form in conventional paper machines of permanently fixed horizontal frame beams to which the upper press roll of the third nip is usually attached.

Embodiments of the invention are also possible wherein a permanently fixed upper frame part of the front frame 50 is provided which corresponds to the pivotable auxiliary frame 51. Such a construction, however, is not generally desired in view of the replacement of the first felt.

Alternatively, the auxiliary frame 51 may also be inclined by means of raising the cantilever beam 110 at the service side of the press section upwardly, the other side of the auxiliary frame 51 being mounted on articulated joints at the operating side of the press section. In such a case, it is not necessary to pivot the auxiliary frame 51 to the position 51' in order to produce the space V at the service side between the frame 50 and the auxiliary frame 51.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for replacing one or more press rolls and/or press fabrics in a paper machine press section which has a compact press roll combination including a first upper press roll, a second lower press roll forming a first press nip with said upper press roll, and a third central press roll forming a second press nip with said upper press roll, said press section further having a first press fabric passing through said first and second press nips and a second press fabric passing through said first press nip, a web adapted to run between said press nips in a longitudinal machine direction, said press section further including a frame construction on which said press rolls and fabrics are mounted, said frame construction including a front frame situated before said roll combination in the direction of web run through the press section and a rear frame separate from said front frame situated after the roll combination in the direction of web run through the press section, said frame construction having a service side and an operating side, said method comprising the steps of:

providing an open or openable space above said roll combination by arranging a first intermediate frame situated above said roll combination, said first intermediate frame having first and second longitudinal ends coupled to said front and rear frames respectively, and pivoting said first intermediate frame about a transverse axis passing through a region of said second end thereof coupled to said rear frame and situated at a longitudinal side of said roll combination; and removing and replacing one or more press rolls and/or press fabrics through said open space above said roll combination.

2. The method of claim 1 wherein said press section further includes a fourth press roll forming a third press nip with said third central press roll and a third upper press fabric passing through said third press nip, said fourth press roll being operatively associated with said first intermediate frame so as to be movable to an open position along with said first intermediate frame, guide rolls including a tensioning guide roll mounted on tensioning means for guiding said press fabric, at least one of said guide rolls being mounted on said first intermediate frame, and wherein said removing and replacing step constitutes removing and replacing said third upper press fabric and is carried out by the steps of:

moving said fourth press roll to an open position and moving said at least one guide roll to an inner position by said pivoting of said first intermediate frame;

shifting said tensioning guide roll to a location situated on said rear frame for temporarily holding said tensioning guide roll;

unwinding a loop of fabric from a roll suspended on a crane from a fixed region on the roll and passing said fabric loop to an operating position;

shifting said tensioning roll onto said tensioning means; and spreading the fabric loop.

3. A method for replacing one or more press rolls and/or press fabrics in a paper machine press section which has a compact press roll combination including a first upper press roll, a second lower press roll forming a first press nip with said upper press roll, and a third central press roll forming a second press nip with said upper press roll, said press section further having a first press fabric passing through said first and second press nips and a second press fabric passing through said first press nip, guide rolls including a tensioning guide roll for guiding said first press fabric which also constitutes a pick-up fabric, a web adapted to run between said press nips in a longitudinal machine direction, said press section further including a frame construction on which said press rolls and fabrics are mounted, said frame construction including a front frame situated before said roll combination in the direction of web run through the press section, a rear frame separate from said front frame situated after the roll combination in the direction of web run through the press section, and an auxiliary frame mounted on said front frame for pivoting about a transverse axis, said auxiliary frame having an operating position wherein an end thereof is normally coupled to said front frame, said tensioning guide roll being mounted on tensioning means mounted on said auxiliary frame, said frame construction having a service side and an operating side, said method comprising the steps of:

providing an open or openable space above said roll combination; and removing and replacing one or more press rolls and/or press fabrics through said open space above said roll combination and wherein said removing and replacing step constitutes removing and replacing said pick-up fabric and is carried out by the steps of:

uncoupling said end of said auxiliary frame from said front frame;

pivoting said auxiliary frame about said transverse axis to an open position;

shifting said tensioning guide roll to a location situated on said front for temporarily holding said tensioning guide roll;

unwinding a loop of fabric from a roll suspended on a crane from a fixed region on the roll and passing said fabric loop from a service side of said frame construction to an operating position; shifting said tensioning guide roll onto said tensioning means mounted on said auxiliary frame;

spreading the fabric loop;

pivoting said auxiliary frame to its operating position; and coupling said end of said auxiliary frame to said front frame.

* * * * *